US006648102B2

(12) United States Patent
Bostelman et al.

(10) Patent No.: US 6,648,102 B2
(45) Date of Patent: Nov. 18, 2003

(54) SUSPENDED DRY DOCK PLATFORM

(75) Inventors: Roger Bostelman, Frederick, MD (US); James Albus, Kensington, MD (US)

(73) Assignee: The United States of America as represented by the Secretary of Commerce, Washington, DC (US)

( * ) Notice: Subject to any disclaimer, the term of this patent is extended or adjusted under 35 U.S.C. 154(b) by 114 days.

(21) Appl. No.: 09/968,882

(22) Filed: Oct. 3, 2001

(65) Prior Publication Data

US 2002/0041794 A1 Apr. 11, 2002

Related U.S. Application Data

(60) Provisional application No. 60/238,312, filed on Oct. 5, 2000.

(51) Int. Cl.[7] ..... E04G 3/10

(52) U.S. Cl. ..... 182/150; 182/130; 182/142; 182/147

(58) Field of Search ..... 182/130, 141, 182/142, 143, 144, 145, 146, 147, 148, 150; 318/568.2; 405/188, 224; 212/146; 414/735

(56) References Cited

U.S. PATENT DOCUMENTS 2,164,128 A * 6/1939 Medenwald ..... 304/9
3,675,786 A * 7/1972 Wilson ..... 212/127
4,039,086 A * 8/1977 Ray ..... 212/47
4,666,362 A * 5/1987 Landsberger et al. ..... 414/735
4,883,184 A * 11/1989 Albus ..... 212/146
5,299,845 A * 4/1994 Gabriel ..... 294/2
5,301,770 A * 4/1994 Regan et al. ..... 182/128
5,354,158 A * 10/1994 Sheldon et al. ..... 409/201
5,585,707 A * 12/1996 Thompson et al. ..... 318/568.2
5,790,407 A * 8/1998 Strickland et al. ..... 364/474.11
5,797,641 A * 8/1998 Lincoln ..... 296/3
6,320,273 B1 * 11/2001 Nemec ..... 290/55
6,496,766 B1 * 12/2002 Bernold et al. ..... 701/50

* cited by examiner

*Primary Examiner*—Bruce A. Lev
(74) *Attorney, Agent, or Firm*—Larson & Taylor, PLC

(57) ABSTRACT

A cabled platform suspension system includes a platform having first and second support points at spaced locations along a front work-access edge of the platform and a third, stabilizing/rotator support point. A platform support structure, such as the two or four towers of a dry dock, defines first, second, third and fourth platform suspension points arranged in a substantially rectangular pattern. Six cables are connected between the platform and support structure, with five cables being respectively connected between the first and fourth suspension points and the first and second platform support points, two cables being respectively connected between the second and third suspension points and the first and second platform support points and two cables being respectively connected between the second and third suspension points and the third platform support point.

22 Claims, 5 Drawing Sheets

SUSPENDED DRY DOCK PLATFORM

This application claims the benefit of provisional application No. 60/238,312, filed Oct. 5, 2000.

FIELD OF THE INVENTION

The present invention relates to cable-supported platforms used in dry dock ship repair and for other purposes.

BACKGROUND OF THE INVENTION

Although as explained below the present invention is not limited to such an application, one important application of the invention is in dry dock ship repair. In this regard, repairs in dry dock on the bow or stern of a ship and, in some instances, on the sides of a ship, present particular difficulties and both the bow and stern are inefficient to access using conventional "stick-built" scaffolding methods. For example, the time taken, and personnel needed, to assemble a single, fixed tower of sufficient height (80 feet) relative to the bow of a ship are quite substantial (on the order of 64 person-hours total).

Other important considerations in providing a workable, efficient support platform system for such an application include the need to provide attachment of the support platform system to a dry dock for ship repair with minimal modifications of the dry dock. Further, set-up and calibration of the system should be simple. In addition, it would be advantageous to be able to access exterior ship hull surfaces without the use of overhead support structures or scaffolding.

A traditional "Stewart Platform" cable configuration with overhead support points has a number of important advantages but does not allow access to some work sites such as a ship bow or stern. Exploring this point in more detail, the basic, six cable Stewart Platform is shown in schematic form in FIG. 1 wherein six cables, denoted C1 to C6, are connected between attachment or suspension points A1, A2 and A3 forming an upper or base triangle. A workpiece or moving platform P is supported by cables C1 to C6. A platform edge, identified as PE, is supported by an associated suspension point A1. An important advantage of this configuration of cables C1 to C6 is that the configuration can control suspended loads, tools, equipment and the like in all six degrees of freedom with sway or rotations. Further, a spine (not shown) can be integrated between the platform P and the support structure to provide tension in all six cables C1–C6 outside of the typical gravity-forced platform work volume. In other words, rather than hanging directly from the upper support points A1–A3 down into a position dictated by gravity, the platform can be pushed to the side using such a spine. The prior art systems include control arrangement which provides control of each of cables C1–C6 using a winch and is powered by a power amplifier. A computer is used to determine the amount of motion that the winch is to undergo to provide the desired cable control, based on sensor inputs. Joystick commands or other computer algorithm commands supplied to the winches can be used to provide complex platform movements which can be controlled throughout the work volume. Pre-programmed platform trajectories allow the operator to pre-plan movements with updated movement path information based on interaction with the environment. For example, the platform can be caused to maneuver around an obstacle placed in the pre-programmed movement path of the platform. Thus, Stewart Platform cable configurations possess a number of features but are limited insofar as providing access to some work sites.

Patents of interest here include the following, the subject matter of which is hereby incorporated by reference: U.S. Pat. No. 2,164,128 (Medenwald); U.S. Pat. No. 4,666,362 (Landsberger, et al.); U.S. Pat. No. 4,883,184 (Albus); and U.S. Pat. No. 5,585,707 (Thompson et al.). Briefly considering the three patents, the Medenwald patent discloses a basic Stewart Platform including a parallel-link manipulator configuration of six cables attached to a crane, with a single winch of the crane used as the lift device for all six cables. The cables stabilize attached loads in six degrees of freedom.

The Landsberger et al. patent discloses a Stewart Platform, parallel-link manipulator of six cables attached in a "tripod" configuration, including a telescoping support spine for the moving platform. Hydraulic power and hydraulic motors are used. The lengths of the cables are independently controlled through the use of power-spools.

The Albus patent discloses a cable and lifting platform of the Stewart Platform type which is used for stabilized load lifting. Load imbalance relative to the center of mass of the platform is sensed and the load is repositioned to control the imbalance. The cables stabilize the attached load in six degrees of freedom.

The Thompson et al. patent discloses a cable-driven Stewart Platform system, which is suspended from above, and also tensioned from below. Platform movement in six degrees of freedom is provided and the central system includes on-board winches, position sensing, optical sensing of tension, and a controller for these functions.

SUMMARY OF THE INVENTION

In accordance with the invention, a platform system is provided which affords a number of important advantages over prior art systems including the Stewart Platform system, and the variations thereon, discussed hereinbefore. As will become more apparent from the discussion below, the present invention enables attachment to a dry dock for use in ship repair with minimum modifications of the dry dock. Further, the system of the invention is simple to set up and to calibrate. In addition, the system of the invention permits accessing of the exterior surfaces of a ship's hull without the need for overhead support structures or scaffolding. Further, the system of the invention enables suspending of a moving platform for carrying workers, tools and equipment, and/or materials to a repair or conversion site, by providing intuitive control through the use of a hand-winch or joystick manual or computer control, throughout a large work volume.

According to the invention, there is provided a cabled platform suspension system comprising:

- a platform including means defining first and second support points at spaced locations along a front work-access edge of the platform and a third, stabilizing/rotator support point;
- a support structure for the platform defining first, second, third and fourth suspension points arranged in a substantially rectangular pattern and from which the platform is suspended; and
- at least six cables connected between the platform and the support structure, the six cables comprising:
  - first and second cables respectively connected between the first and fourth suspension points and the first and second support points on the platform;
  - third and fourth cables respectively connected between the second and third suspension points and the first and second support points on the platform; and fifth and sixth cables connected between the second and third suspension points and the third support point on the platform.

In one preferred embodiment, the platform includes first and second laterally and oppositely extending support members and the first and second support points are located at respective distal ends of the support members. Advantageously, the platform further includes a rearwardly extending support member having a distal end and the third support point is located at the distal end of said rearwardly extending support member. Preferably, the platform comprises a platform member and the rearwardly extending support member comprises a centrally disposed support strut affixed to a rear edge of the platform member and first and second tie elements extending between the distal end of the support strut and the rear edge of the platform member on opposite sides of the support strut.

In accordance with a preferred implementation, the suspension points are respectively located on the towers of a dry dock facility.

In a further preferred embodiment, the platform comprises a V-shaped platform member having a central portion and first and second angled leg portions and including a support strut extending rearwardly of the central portion and having a distal end, the first and second support points being respectively located at distal ends of the leg portions and the third support point being located at the distal end of the support strut. Advantageously, the platform further comprises a downwardly depending element affixed to the distal end of the support strut and first and second tie members connected between the element and the distal ends of the leg portions.

In yet another preferred embodiment, the platform includes a main platform and an elevator sub-platform movable, in use, between a ground location and a position on the main platform.

In a further advantageous embodiment, the platform includes a platform member, a centrally disposed, downwardly depending truss member and a plurality of tie elements connected between the truss member and distal ends of the platform member.

In an advantageous implementation, the platform comprises a platform member of a modular construction. Preferably the platform member comprises a plurality of separate, removable platform sections.

Advantageously, the platform member comprises a corrugated sub-deck.

The cabled platform suspension system preferably comprises control means for controlling the cables to provide manipulation of the platform through a defined work volume, the control means including a tension sensor for each cable for sensing the cable tension on the associated cable. Advantageously, the system further comprises a pulley for each cable, each of the tension sensors being disposed between a portion of said platform and the associated pulley. Preferably, the system further comprises a winch for each cable, each of the cables extending from the associated winch through the associated pulley to the corresponding support point on the platform. The control means preferably further comprises a motor including a rotating motor shaft for driving each of the winches and at least one of a position sensor, an encoder and a tachometer for monitoring a parameter associated with rotation of the motor shaft and means for controlling the associated winch in accordance with that parameter.

Preferably, the system further comprises magnetic means for securing the platform to at least one work site surface to stabilize platform positioning. Advantageously, the magnetic means comprises a plurality of movable electromagnets.

The system preferably further comprises control means for controlling the cables so as to manipulate the platform throughout a defined work space, wherein the control means including a joystick controller comprising a base, a movable plate member simulating the platform and six linear potentiometers connected between said base and said movable member in manner replicating the connections between said six cables and said support points and said suspension points. Preferably, the control means further comprises a winch for each of the six cables, a power amplifier, associated with each linear potentiometer and each winch, for receiving a control signal from a corresponding one of linear potentiometers and for, based on that control signal, producing a further control signal for controlling operation of the associated winch.

Further features and advantages of the present invention will be set forth in, or apparent from, the detailed description of preferred embodiments thereof which follows.

DESCRIPTION OF THE PREFERRED EMBODIMENTS

As indicated above, the traditional Stewart Platform cable configuration with overhead support points does not permit access to certain work sites, such as the bow or stern of a ship. As was also indicated previously, and will be discussed in more detail below, an important aspect of the invention concerns the provision of a system which is reconfigured so as to enable access of the platform edge to a work area without support points directly overhead of that edge.

Figure 1:
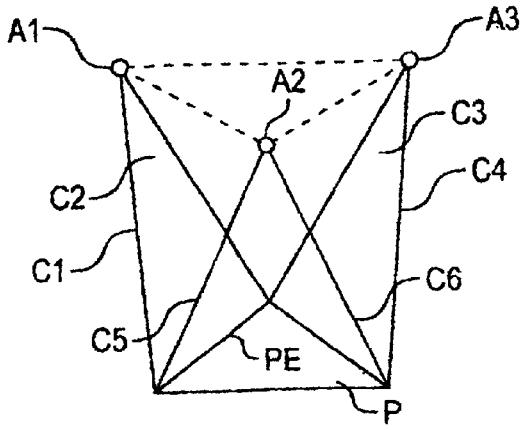
FIG. 1 is, as described above, a perspective view of a schematic representation of the basic prior art Stewart Platform.
Figure 2:
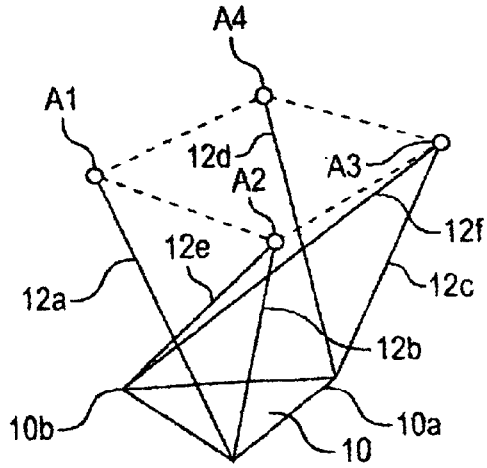
FIG. 2 is a perspective view, similar to that of FIG. 1, of a schematic representation of a platform and cabling arrangement in accordance with the invention.

Referring to FIG. 2 wherein a platform is indicated at 10 and six supporting cables are denoted 12*a*–12*f*, and comparing FIG. 2 with FIG. 1, it will be seen that suspension point A1 of FIG. 2 has essentially been split into two points, A1 and A4 in FIG. 2, and cables 12*a* and 12*d* which correspond to cables C1 and C2 of FIG. 1, are individually suspended from points A1 and A4. By separating one pair of the suspension cables, viz., cables 12*a* and 12*d* of FIG. 2 and separately attaching the cables to upper support points, viz., points A1 and A4 in FIG. 2, and rolling the platform 10 about the platform edge 10*a*, the arrangement in FIG. 2 enables the six-cable configuration to provide work platform stabilization throughout a large volume under an overhanging structure.

A stabilizer/rotator point is provided on platform 10 at 10*b* and the opposing stabilizer/rotator cables 12*e* and 12*f* provide directional "pull" toward the target or work access location. The separated cables 12*a* and 12*d* and the front cables 12*b* and 12*c* provide "lift" or vertical support for the front work-access edge 10*a* without these cables hindering access to the work site itself. Further, these cables provide side-to-side control as well.

Figure 3:
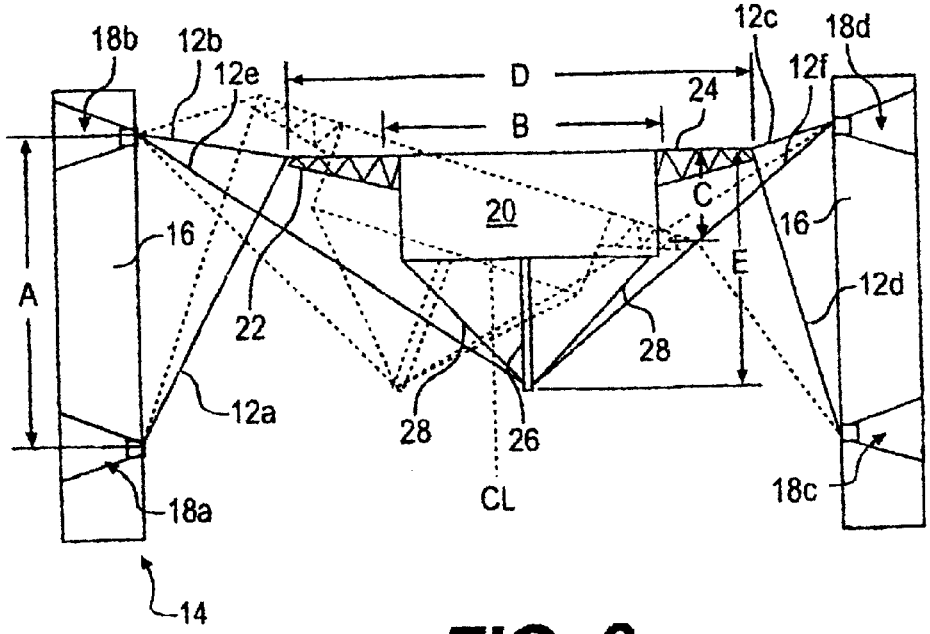
FIGS. 3 and 4 are, respectively, a top plan view and an end elevational view of a first embodiment of the invention.
Figure 4:
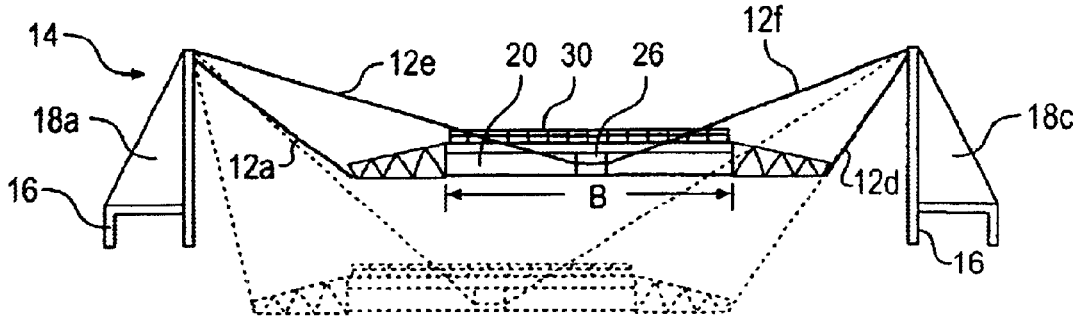

It will, of course, be appreciated that the platform arrangement of FIG. 2 can take a number of different practical forms. Several advantageous embodiments will now be described. Referring to FIGS. 3 and 4, there is shown an "outrigger" platform construction that is particularly useful for wider dry docks and/or smaller platforms. In FIGS. 3 and 4, a typical dry dock, generally denoted 14, is represented schematically by a pair of spaced side rails 16 and four towers 18*a*–18*d* arranged two on each side as shown in FIG. 3. The four towers 18*a*–18*d* correspond, of course, to the four support points A1–A4 of FIG. 2. A generally rectangular platform 20 includes oppositely extending lateral truss members 22 and 24 and a rear support member or "tail" 26 affixed to platform 20 and also supported by a pair of compression ties 28. The platform 20 may also include an upper railing 30.

To simplify the correspondence between the cables in FIGS. 3 and 4 and those of FIG. 2, the supporting cables have been given the same numbers in the former figures as in the latter. Cables 12*a* and 12*d* are respectively connected between towers 18*a* and 18*c* and the outboard ends of members 22 and 24 and cables 12*b* and 12*c* are respectively connected between towers 18*b* and 18*d* and the same outboard ends of members 22 and 24, as shown. Cables 12*e* and 12*f* are respectively connected between towers 18*b* and 18*d* and the outboard end of rear support member 26.

As indicated above, the cabling system of the invention enables the platform to be moved through six degrees of freedom. Several different positions are shown in FIGS. 3 and 4. In FIG. 3, the center line of the dry dock system between rails 16 is indicated at CL and the platform 20 is, as shown in solid lines, offset laterally from center line CL. Another position of the platform 20 is shown in dashed lines wherein platform 20 is angled or skewed with respect to center line CL. Further, FIG. 4 shows, in dashed lines, the platform 20 after being lowered and moved to one side.

Although it will, of course, be appreciated that the overall system and the platform itself can be of varying sizes, to provide some indication of the system scale, in a typical, non-limiting example, the distance A between towers 18*a* and 18*b* is 70', the length B and width C of platform 20 are 60' and 20', respectively, the distance D between the outboard ends of members 22 and 24 is 100' and the distance to the tip of member 26 is 52' 8".

Figure 5:
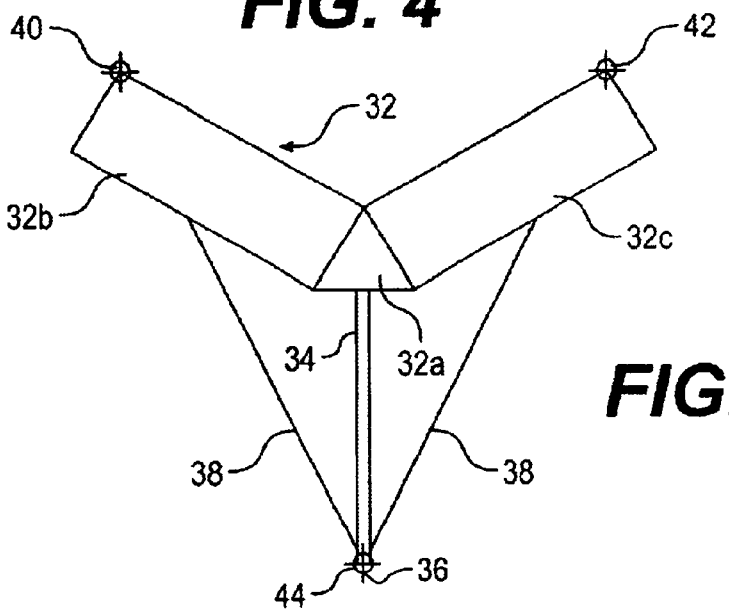
FIGS. 5 and 6 are, respectively, a top plan view and an end elevational view of a further embodiment of the invention.
Figure 6:
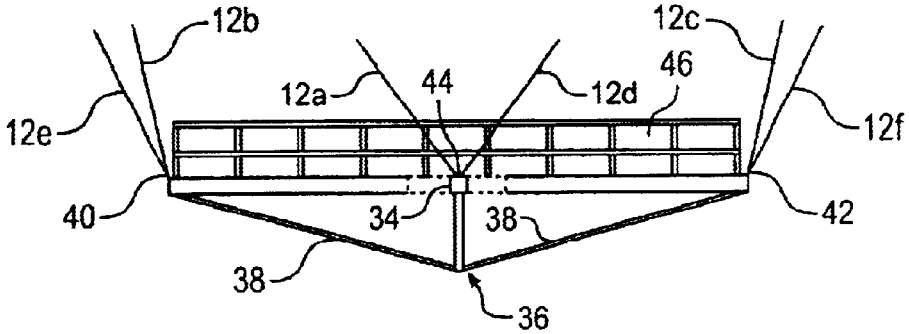

A further embodiment is shown in FIGS. 5 and 6, wherein an angled platform structure 32 includes a triangular central portion 32*a* and angled portions 32*b* and 32*c*. A rear strut member 34 extends rearwardly of central portion 32*a* while a rear leg 36, shown in FIG. 6, extends downwardly from the free end or tip of member 34 and is connected by a pair of tie elements 38 to suspension points 40 and 42 at the most distal parts of angled platform portions 32*b* and 32*c*. A third suspension point 44 is provided at the tip or outboard end of member 34. A railing 46 for platform 32 is shown in FIG. 6. The corresponding cables, again denoted 10*a*–10*f*, are also shown in FIG. 6.

Figure 7:
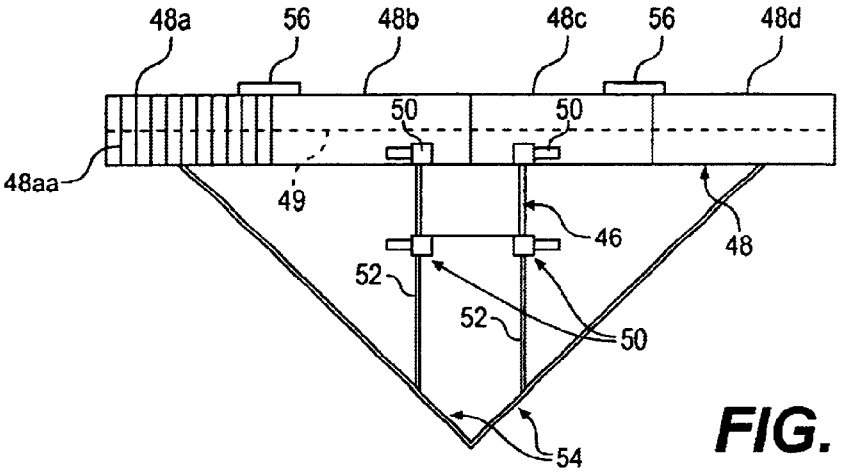
FIGS. 7 and 8 are, respectively, a top plan view and a side elevational view of yet another embodiment of the invention.
Figure 8:
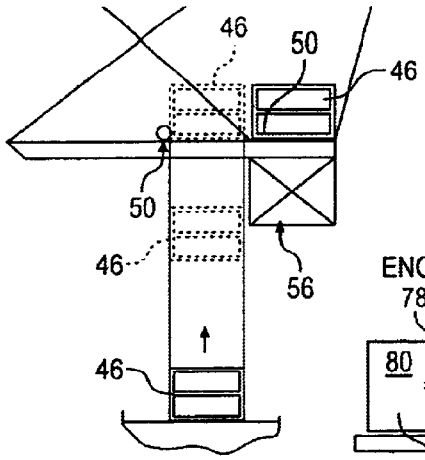

Referring to FIGS. 7 and 8, yet another embodiment of the invention is shown. In this embodiment, a secondary or sub-platform 46 is used as an elevator. A main or basic platform 48 is provided and elevator hoists 50 are employed which are mounted on platform 48 and on rearwardly extending support members 52. Members 52 are affixed to angled stabilizer/rotator members 54, which are connected together at an apex 56, as shown. Apex 56 is connected to cables corresponding to cables 12*a* and 12*b* (one of which is shown in FIG. 8). A centrally, located downwardly depending support strut configuration 58 is affixed to the bottom of platform 48 centrally thereof, and is connected by cables (not shown) to the opposite ends of platform 48.

The elevator 46 enables materials, equipment and/or personnel to access the platform 48. The platform 48 can thus be parked in a desired position and the necessary resources supplied to the work site without moving platform 48. This provides an efficient and effective way to enable continuous work at a work site since the main platform 48 need not be moved once in the desired target position.

A further feature of this embodiment, which is also applicable to the previously described embodiments, concerns the provision of electromagnets as indicated schematically at 56, at the front edge of platform 48. This provision enables the platform to be attached to the ship to provide additional stability. The electromagnets 56 can be repositioned where needed along the platform 48 and serve to provide back-up or additional platform support (in addition to the cables) so as to afford improved on-board worker safety.

An additional feature of this embodiment, which is also applicable to the previous described embodiments, concerns the provision of a truss-style, reconfigurable platform construction which results in a lightweight platform construction having equal or greater load capacity. This is indicated in a highly schematic manner in FIGS. 7 and 8 and in FIG. 6, which basically corresponds to an end view of the embodiment of FIGS. 7 and 8. In accordance with this feature, the platform 48 is made of steel joints and cables that form a rigid platform. Lower cables, generally corresponding to cables 38 of FIG. 6, together with downwardly depending strut configuration 58 shown in FIG. 8, provide a truss design allowing the center of platform 48 to be supported with suspension cables on only the platform ends. The truss construction prevents platform sway and adjustment of the truss cables can be effected in accordance with the platform payload and/or the desired platform preload in order to provide the requisite rigidity. The rear stabilizer, including stabilizer/rotator members 54, completes the triangular shape of the work platform and provides a lightweight lift point constrained by two cables (not shown) attached to the platform ends. Thus, the overall system is in nearly full tension and compression except for self-weight.

As shown for platform section 48*a* of FIG. 7, the platform 48 can be of a modular construction made up of a plurality of platform sections (as represented by further sections 48*b*, 48*c* and 48*d*) and as indicated for section 48*a*, corrugated decking 48*aa* can be used to form the basic platform, together with railings (as shown, e.g., at 46 in FIG. 6) and a smooth decking covering the corrugated decking 48*aa* for onboard personnel use. It is to be understood that different configurations of platform sections or modules can be used to give the overall platform a smaller or more narrow profile. Thus, as indicated schematically by dashed line 49, the modules or sections could be such as to provide transverse diversion of platform 48 so as to give the platform a more narrow width profile.

Figure 9:
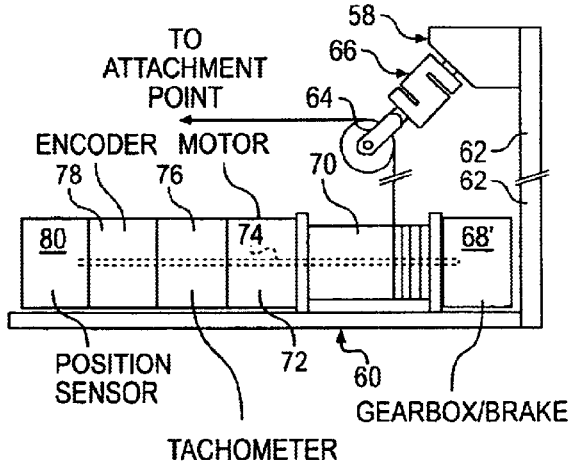
FIG. 9 is a side elevational view, partially in block diagram form, of a preferred embodiment of a cable tension sensing and control arrangement in accordance with the invention.

A further important feature of the invention concerns the use of tension control to manipulate the platform throughout a defined work volume constrained by desired cable tensions. Referring to FIG. 9, a schematic, block diagram representation of a servo-control system used for this purpose is shown. In FIG. 9, a portion of a moving platform is indicated at 58 while a winch support structure connected to platform 58 is indicated at 60 and a connecting member at 62. A pulley 64 is connected to platform 58 through a tension sensor 66.

Mounted on winch support structure 60 are a gearbox/brake 68, a cable spool 70, a motor 72 including a motor drive shaft 74, a tachometer 76, a relative encoder 78 and an absolute position sensor 80. A cable 82 extends from cable spool 84 through pulley 64 to an attachment point. A tension sensor, corresponding to sensor 66, is attached to all six cables to provide continuous feedback to the controller to give continuous cable tension updates. The tension related control signal from sensor 66 together with position and/or velocity control signals from position sensor 80, relative encoder 78, and/or tachometer 76 provide that the commanded platform movement not drive cable tensions above their safe maximum tension values or below their minimum effective tension values.

It is noted that the ideal location for the on-board winches and other loads is at the rear attachment point. This allows the system center of gravity to be located behind the platform so as to create maximum stability.

Figure 10:
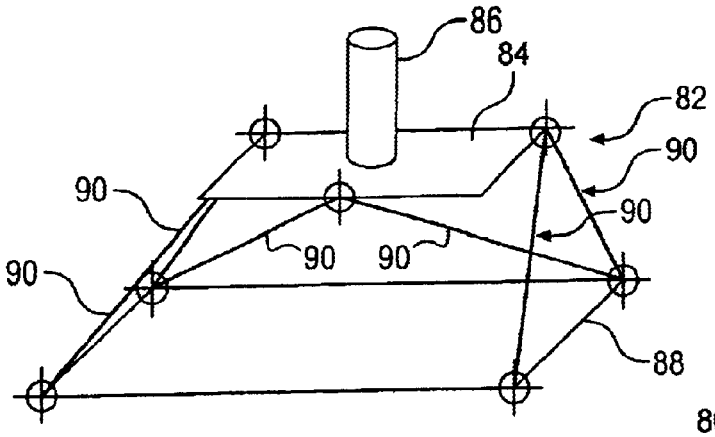
FIGS. 10 and 11 are, respectively, a perspective view and a side elevational view of a joystick controller in accordance with a preferred embodiment of the invention.
Figure 11:
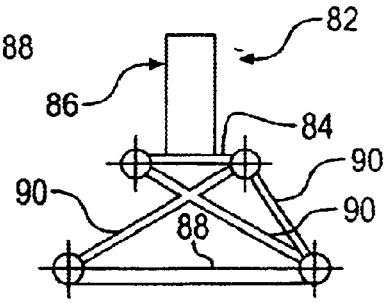
Figure 12:
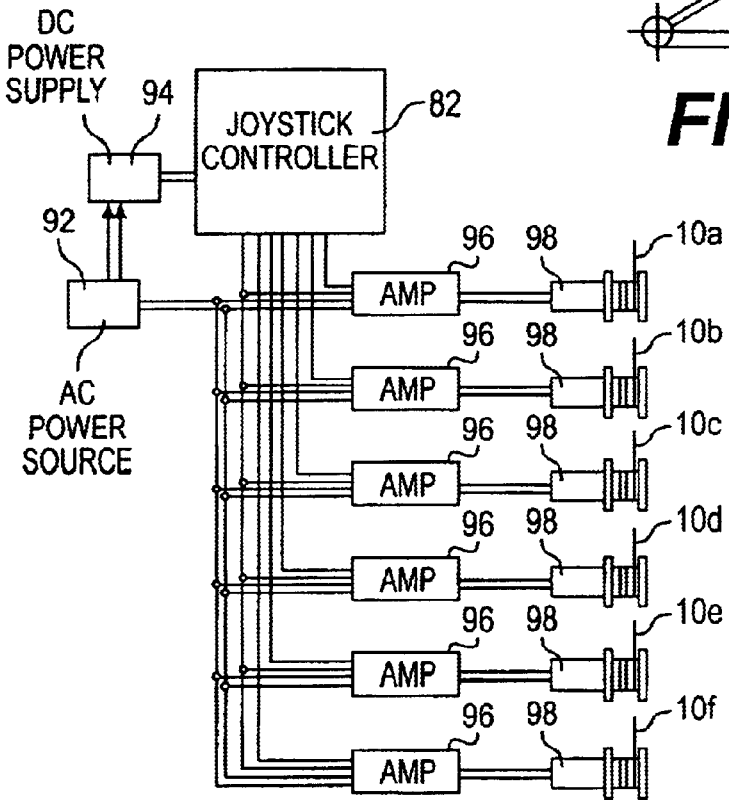
FIG. 12 is a schematic diagram of a simplified system incorporating the joystick controller of FIGS. 10 and 11.

A further important feature of the invention concerns the provision of a replica-master joystick, which is used to drive the platform intuitively and without the use of a computer. Referring to FIGS. 10 to 12, and first to FIGS. 10 and 11, a joystick device 82 includes a moving plate 84 to which a control handle 86 is affixed. The device 82 is supported by base plate 88 which is connected to moving plate 84 by six linear potentiometers 90 corresponding to the six cables of the embodiments previously described above. As illustrated, the potentiometers 90 are attached at four points to base plate 88 and at three points to moving plate 84 and thus are disposed in a pattern or configuration corresponding to that for the cables of, e.g., FIG. 2.

Referring to FIG. 12, a simplified controller is shown with the joystick controller 82 integrated therein. In FIG. 12, an AC power supply 92 (e.g., 115 VAC at 60 amperes) is connected to DC power supply 94 (e.g., ±12 VDC at 1 ampere) and to six hoist amplifiers 96. Amplifiers 96 also receive individual input signals from respective ones of the six potentiometers 90 of the joystick controller device 82. The outputs of amplifiers 96 are each connected to a respective one of six winches 98 for the respective six cables 10*a*–10*f*.

In operation, a user manipulates control handle 84 so as to position moving platform 84 as desired and thus commands corresponding positioning of the actual platform (e.g., platform 10 of FIG. 2). The linear potentiometers 90 provide direct, proportional signals to hoist amplifiers 96 and drive the servo system using velocity control.

As indicated above, the invention can be used, *inter alia*, to access both the bow and stern of ship as well as the sides of ship. Referring to FIGS. 13 to 16, there is shown a further embodiment of the invention which permits this to be achieved. An important feature of this embodiment is that the platform configuration can be transitioned between a side access configuration and a bow/stern access configuration as described below in connection with FIGS. 13 and 14.

Figure 13:
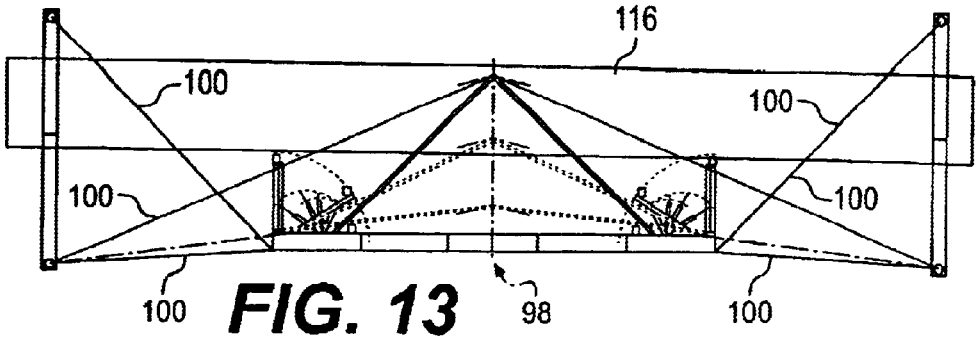
FIG. 13 is a top plan view of a further embodiment of the invention, showing the platform in use.
Figure 14:
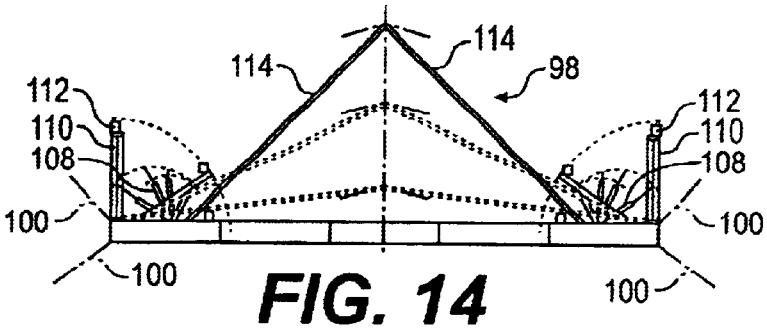
FIG. 14 is a top plan view, similar to that of FIG. 13, showing the platform of FIG. 13.
Figure 15:
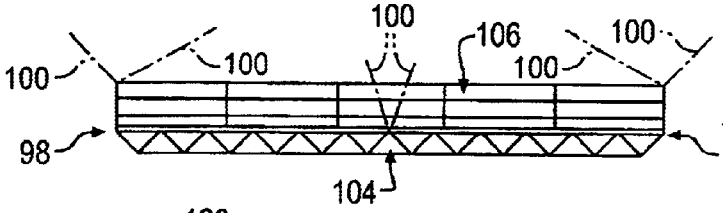
FIG. 15 is a front elevational view of the platform of FIG. 13.

In FIGS. 13 to 16, the platform configuration, which is generally denoted 98, has supporting cables 100 connected thereto as described above (so that the connections of the individual cables will not be described again here). As shown in FIG. 15, a platform member 102 includes a lower truss construction or truss 104 and an upper scaffold 106. The truss 104 is useful for heavy duty platform applications, such as lifting and positioning of heavy loads, and the truss 104 can be sized according to the anticipated loading.

As shown in FIG. 14, the platform 102 further includes, at opposite ends thereof, a pair of hydraulic actuators 108 connected to corresponding pivotable and extensible wheel support arms 110. Wheel support arms 110 terminate in push wheels 112 which are adapted to engage the walls of the dry dock when the arms 110 are pivoted, as indicated by the various positions shown, from a position wherein arms 110 lie adjacent to platform member 102 and to the position illustrated in FIG. 14 wherein arms 110 extend substantially perpendicular to platform member 102. Thus, push wheels 112 can roll along the corresponding dry dock wall to provide added platform stability.

Returning to FIGS. 13 and 14, rearwardly extending strut or support members 114 are provided which form a "tail" and which generally correspond to those described above (e.g. members 54 of FIG. 7). However, in this embodiment, members 114 are mounted on platform member 102 so that the inboard ends thereof can be moved along the rear edge of platform member 102. It will be appreciated that this can be effected in a number of different ways and that, e.g., the inboard ends of members 114 can terminate in rollers (not shown) received in tracks (not shown) so as to be movable linearly along the associated tracks, thereby to assume, and be locked in, the various positions indicated in dashed lines. The outboard or distal ends of members 114 are pivotably connected together so that, as illustrated, the common pivotable end of the "tail" moves toward and away from the platform member 102 as the inboard ends of members 114 move toward and away from the free ends of platform member 102. The purpose of this construction is to enable the "tail" formed by members 114 to assume a narrow profile and thus, referring to FIG. 13, to fit within the space between the dry dock wing wall indicated at 116 in FIG. 13 and the side of the ship being accessed.

Figure 16:
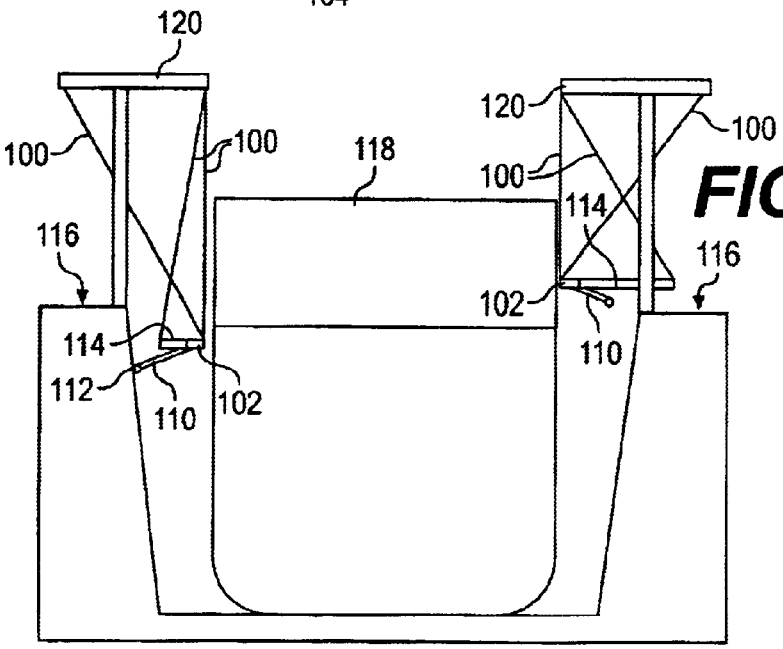
FIG. 16 is a side elevational view of a dry dock showing two platforms in use on opposite sides of a ship.

Referring to FIG. 16, two platforms 102 are shown positioned on opposite sides of a ship 118, adjacent to the ship's sides. As shown on the left side of FIG. 16, with the wheel arms 110 extended and the push wheels 112 in contact with the dry dock wing walls 116, the platform 102 is further stabilized. As illustrated, the rearwardly extending support members 114 have been retracted so that the platform 102 readily fits between the dry dock walls 116 and the ship 118. It will be appreciated that when the upper portions of side walls 116 of the ship 118 are to be accessed, retraction of support members 114 is not required and this is illustrated by the platform 102 on the right side of FIG. 16. The extended "tail" formed by members 114 provides added stability. As shown in FIGS. 13 and 16, two towers 120 provide the four suspension points for the cables 100. It is noted that the same two towers can be used for bow/stern access (in contrast to FIG. 3 wherein four towers are shown) so that the towers 120 are reconfigured as well. In general, two towers provide the best and simplest support approach, with the remaining two cables attached at a lower point on the dry dock wing wall.

It will be understood from the foregoing that the platform and cable configuration of the invention represents a significant improvement over the original Stewart Platform configuration and the improvements thereon and variations thereof discussed above, particularly with respect to providing access to areas that are difficult to access such as the bow and stern of a ship. The invention permits intuitive operation of a work platform against the bow, stern or side of a ship hull while being suspended from dry dock "hard points" or superstructures such as towers, cranes or the like.

The modularity of the invention described above in general terms in connection with FIG. 7 enables reconfiguring of the platform shape to assist in providing, e.g., bow/stern access or side access. The servo system is modular as well so as to provide reconfigurability of the platform, and thus the invention not only provides work-volume reconfigurability but also reconfigurability of the suspended platform.

As mentioned above, the adaptability of the invention provides advantages over currently used approaches such as mounting scaffolding and boom lifts. In this regard, scaffolding provides a fixed position for minimal access to the ship hull surface. Boom lifts provide non-rigid support of one or two workers; welding is extremely difficult from boom lifts. The present invention provides a lightweight alternative to manipulators or other conventional methods currently available.

The present invention also provides the ability to move workers, tools and/or equipment to new locations with minimal set-up time. Moreover, the invention provides platform maneuverability from above and to the side of the work site where there is typically unused work volumes. The invention can be attached to many different structures such as walls, ceilings, support structures, cranes, bridges, radio towers, and other structures covering a very large work volume.

In the embodiment of the invention wherein a replica/joystick device is used (see foregoing discussion with respect to FIGS. 10 to 12), recalibration is achieved by reconfiguring the replica master to approximate the configuration of the suspension points. If the platform movement is computer controlled, recalibration can be effected by providing the coordinates of the suspension points or tracking through known points in the work volume and measuring the cable lengths at each point.

The invention has many potential applications. The application thereof to shipbuilding has been discussed to some extent above. In shipbuilding, equipment and machines for welding, cutting, grinding and the like are continuously moved from work site to work site as different work sites need the equipment for performing different tasks. Tool set-up and use is a cumbersome, tedious and time-consuming process and can be basically equated to inefficient pre-process and process methods. The invention enables efficient movement of such equipment to the work site for local use and enables carrying of large awkward loads, such as steel plates, to be readily accomplished so that such a plate can be fixtured in place while workers weld the plate to the ship hull. Further, the platform reconfigurability described above enables the platform to be reconstructed to adapt the same to specific applications at the site, such as work on the sides of a ship.

More generally, the platform can be fitted with a variety of gripping devices to lift and precisely position loads. The platform can exert controlled forces to mate and seat loads and can resist perturbations such as wind and inertial forces. Vacuum, water and/or air hoses can also be manipulated from the platform. It is envisioned that precision motions of 0.125 inches and 0.5 degrees will be achieved while maneuvering loads in manual, semi-autonomous and autonomous control modes.

Other potential applications include the following: aircraft maintenance (in providing worker, equipment and tool access to aircraft surfaces for maintenance or manufacturing of the aircraft); construction (in providing worker, equipment and tool access to walls, ceilings and superstructures by attachment to these superstructures as supports or to towers or the like); laboratory/high bay access (in providing personnel and tool access through tall or shallow, open center buildings (e.g., quanset huts, warehouses and other building styles) without ground support equipment such as lifts); and decontamination and decommissioning of nuclear facilities (in providing personnel and tool access throughout tall or shallow, open center buildings without touching potentially decontaminated floors, obstacles and/or equipment).

Although the invention has been described above in relation to preferred embodiments thereof, it will be understood by those skilled in the art that variations and modifications can be effected in these preferred embodiments without departing from the scope and spirit of the invention.

What is claimed:

1. A cabled platform suspension system, said system comprising:

a platform including supporting means defining first and second support points at spaced locations along a front work-access edge of the platform and a third, stabilizing/rotator support point;

a support structure for the platform defining first, second, third and fourth suspension points arranged in a substantially rectangular pattern and from which said platform is suspended; and at least six cables connected between said platform and said support structure, said six cables comprising:

first and second cables respectively connected between said first and fourth suspension points and said first and second support points on said platform;

third and fourth cables respectively connected between said second and third suspension points and said first and second support points on said platform; and fifth and sixth cables respectively connected between said second and third suspension points and said third support point on said platform.

2. A cabled platform suspension system according to claim 1 wherein said platform includes first and second laterally and oppositely extending support members and said first and second support points are located at respective distal ends of said support members.

3. A cabled platform suspension system according to claim 2 wherein said platform further includes a rearwardly extending support member having a distal end and said third support point is located at the distal end of said rearwardly extending support member.

4. A cabled platform suspension system according to claim 3 wherein platform comprises a platform member and said rearwardly extending support member comprises a centrally disposed support strut affixed to a rear edge of said platform member and first and second tie elements extending between the distal end of said support strut and said rear edge of said platform member on opposite sides of said support strut.

5. A cabled platform suspension system according to claim 1 wherein said suspension points are respectively adapted to be secured to towers of a dry dock facility.

6. A cabled platform suspension system according to claim 1 wherein said platform comprises a V-shaped platform member having a central portion and first and second angled leg portions and including a support strut extending rearwardly of said central portion and having a distal end, said first and second support points being respectively located at distal ends of said leg portions and said third support point being located at the distal end of said support strut.

7. A cabled platform suspension system according to claim 6 wherein said platform further comprises a downwardly depending element affixed to the distal end of said support strut and first and second tie members connected between said element and said distal ends of said leg portions.

8. A cabled platform suspension system according to claim 1 wherein said platform includes a main platform and an elevator sub-platform movable, in use, between a ground location and a position on said main platform.

9. A cabled platform suspension system according to claim 1 wherein said platform includes a platform member, a centrally disposed, downwardly depending truss member and a plurality of tie elements connected between said truss member and distal ends of said platform member.

10. A cabled platform suspension system according to claim 1 wherein said platform comprises a platform member of a modular construction.

11. A cabled platform suspension system according to claim 10 wherein said platform member comprises a plurality of separate and removable platform sections.

12. A cabled platform suspension system according to claim 1 wherein said platform member includes a corrugated sub-deck.

13. A cabled platform suspension system according to claim 1 further comprising control means for controlling said cables to provide manipulation of the platform through a defined work volume, said control means including a tension sensor for each cable for sensing the cable tension in the associated cable.

14. A cabled platform suspension system according to claim 13 further comprising a pulley for each cable, each said tension sensor being disposed between a portion of said platform and the associated pulley.

15. A cabled platform suspension system according to claim 14 further comprising a winch for each cable, each said cable extending from the associated winch through the associated pulley to the corresponding support point on the platform.

16. A cabled platform suspension system according to claim 15 wherein said control means further comprises a motor including a rotating motor shaft for driving each of said winches and at least one of a position sensor, an encoder and a tachometer for monitoring a parameter associated with rotation of the motor shaft and means for controlling the associated winch in accordance with said parameter.

17. A cabled platform suspension system according to claim 1 further comprises securing means, including magnetic members, for securing the platform to at least one work site surface in order to stabilize platform positioning.

18. A cabled platform suspension system according to claim 17 wherein said magnetic members comprise a plurality of movable electromagnets.

19. A cabled platform suspension system according to claim 1 further comprising control means for controlling said cables so as to provide manipulation of said platform throughout a defined work space, said control means including a joystick controller comprising a base, a movable plate member simulating said platform and six linear potentiometers connected between said base and said movable member in manner replicating the connections between said six cables and said support points and said suspension points.

20. A cabled platform suspension system according to claim 19 wherein said control means further comprises a winch for each of said six cables, a power amplifier associated with each of said linear potentiometers and with each of said winches, for receiving a control signal from a corresponding one of said linear potentiometers and for, based on said control signal, producing a further control signal for controlling operation of the associated winch.

21. A cabled platform suspension system according to claim 20 wherein said platform includes a platform member and a rearwardly extending support tail, which is movable relative to the platform member to change the width profile of the platform and on which said third support point is located.

22. A cabled platform suspension system according to claim 21 wherein said platform member includes pivotable and extensible support arms affixed to the rear edge thereof, said support arms including distal push rollers for engaging a dry dock wall.

* * * * *